US005190002A

United States Patent [19]

Wietig

[11] Patent Number: 5,190,002

[45] Date of Patent: Mar. 2, 1993

[54] ENGINE VALVE

[75] Inventor: Frederick G. Wietig, West Falls, N.Y.

[73] Assignee: Val-Kro, Inc., Tonawanda, N.Y.

[21] Appl. No.: 937,181

[22] Filed: Aug. 31, 1992

[51] Int. Cl.[5] ..... F01L 3/00

[52] U.S. Cl. ..... 123/188.3; 123/188.6; 123/188.11; 29/888.4

[58] Field of Search ..... 123/188.3, 188.6, 188.11; 29/888.4, 888.42, 888.43, 888.45

[56] References Cited

U.S. PATENT DOCUMENTS

| | | | |
|---|---|---|---|
| 1,949,592 | 3/1934 | Verderber | 29/888.4 |
| 3,461,001 | 8/1969 | Kubera | 29/888.4 |
| 4,359,022 | 11/1982 | Nakamura et al. | 123/188.3 |
| 4,728,374 | 3/1988 | Larson et al. | 123/188.3 |
| 5,076,866 | 12/1991 | Koike et al. | 123/188.3 |

*Primary Examiner*—E. Rollins Cross
*Assistant Examiner*—Erick Solis
*Attorney, Agent, or Firm*—James J. Ralabate

[57] ABSTRACT

The novel valve of this invention is for use in internal combustion engines. With advanced engine technology of today, prior art valves are not suitable because of wear problems. The valve of this invention provides a valve stem texture that is smooth enough to cause minimal wear on contacting parts while at the same time rough enough to retain sufficient oil to lubricate the parts. This is accomplished by having a stem surface with a surface peak height of Rp 4.0 to 15.0 and cross hatching on the affected surface portions. The cross hatching has a depth having an Rvk value of up to 30 micro-inches.

17 Claims, 5 Drawing Sheets

ENGINE VALVE

This invention relates to a novel engine valve and, more particularly, to a valve having an increased useful life and more suitable for today's high compression engines.

BACKGROUND OF THE INVENTION

Today's advancements in internal combustion engines have required equal improvements in many component parts. For example, because of the stringent environmental emission government standards, many of the prior art engines required new and improved engine valves that would minimize the amount of oil permitted to enter the valve guide or combustion chamber. At the same time, however, proper lubrication of the valve train and valve wear remain primary concerns for today's advanced engines.

The mating surfaces of the stem of an engine valve in an internal combustion engine presents a wear concern if the metallurgical structure and roughness profile of the stem are such that galling or abrasion between the mating surfaces occurs. As the auto industry has evolved, both engine durability and emission control requirements have placed additional burdens on engine valve finishes.

An early advance in the art was to chrome plate engine valves on a mass production basis. Initially, chrome thickness of 0.00015 to 0.00025 inches with a hardness of Rockwell C 65 was sufficient to prevent galling on the exhaust valve stems of V8 engines. "Galling" is defined as an action approaching cold welding, such action causing adjacent surfaces to have a tendency to stick to each other.

Since that time, the stems of millions of automotive engine valves (particularly exhaust valves) have been plated with hard chrome to minimize galling. The process became more popular in the mid 1970's when emission standards were specified for U.S. automobiles.

When chrome is applied to engine valve stems, it is very hard and resides on the stem surface with microscopic nodules and unevenness. These characteristics can cause valve guide and valve seal wear. In the late 1970's and early 1980's these nodules were identified as the primary cause of valve guide wear and premature engine failure. Chrome nodules were identified as the source of the problem. It was at this time that polishing an engine valve was proposed so that a maximum peak height of the nodules was under 32 Rp micro inches after plating and polishing. This development became the standard industry procedure in the 1980's for eliminating guide wear and/or galling of the valve stem on North American-produced engines.

There have been prior art valves that have been concerned with valve treatment to improve wearability and performance of engine valves. Some of the prior art features are disclosed in U.S. Pat. Nos. 1,569,455 (Burwell); 1,599,172 (Goodbrake); and 3,345,976 (Pope, et al.).

Burwell teaches the use of an annular oil groove 16 which is formed in the upper valve stem portion. The oil groove 16 is normally located just below an asbestos wiper; when the valve is opened, oil will be carried by groove 16 to the asbestos wiper. Groove 16 is in communication with spiral grooves 17 which are provided around the valve stem to a point adjacent to the lower end of the valve guide. Nowhere is Burwell concerned with the surface smoothness of the valves to prevent abrading and wearing. Burwell's objective is merely to lubricate the valve and is not concerned with a long-wearing valve adapted for today's advanced internal combustion engines nor is he concerned with emission problems. Naturally, Burwell's patent in 1926 could not have suggested the problems or solutions for today's complex engine and valve requirements.

Goodbrake (U.S. Pat. No. 1,599,172) also discloses the use of a spiral groove 6 of about one-sixteenth of an inch deep. Again, Goodbrake's invention is concerned with 1926 engine problems and is not directed to 1992 present day high-tech valve-engine concerns or emission standards. At the time of Burwell and Goodbrake's inventions, proper lubrication was believed to be solely responsible for preventing valve wear and galling. Today we know that valve surface imperfections and nodules are primary causes of galling and of seal and valve guide wear. Nowhere does Goodbrake suggest investigating surface smoothness to minimize seal and valve guide wear.

U.S. Pat. No. 3,345,976 (Pope, et al.) shows a valve for an internal combustion engine having an annular longitudinal groove **11*b* which connects the flats 21 and 20 so that the lubricant flows down one of the flats 20, 21. The flow of lubricant in Pope is greater in volume than would normally occur. The increase volume alledgedly insures frequent change of the lubricant volume located in the annular recess 11*b* and renewal of lubricant in the flats 20 and 21**. Longitudinal grooves such as those suggested by Pope could cause accelerated wear on seals and valve guides as will be later discussed.

With today's strict emission standards for internal combustion engines, none of the lubricating expedients suggested by Burwell, Goodbrake or Pope, et al would suffice. For example, the 1/16 inch groove of Goodbrake would hold far too much oil and would likely cause oil to enter the combustion chamber causing severe emission problems.

Cross hatching of the present invention is far superior in today's engines than the above spiral or longitudinal grooves because of lead-in problems possible with spiral and longitudinal grooves. Additionally, cross hatching aids in low engine idling and cold starting conditions.

Recently, after 1965, engine manufacturers have introduced tighter valve tolerance requirements and introduced new valve seals in an effort to reduce emissions and restrict the flow of excess oil down the valve stem and into the combustion chamber. As these emission standards became more stringent and valve seal design became more sensitive to seal abrasion and seal wear, more advanced methods and technology were researched to produce a mating surface on the valve stem that would provide good wear properties on the valve guide and the seal.

It has been determined that the microscopic texture of the valve stem surface caused the wear and could be reduced to a plateau-like surface and therefore be controlled to support an oil film in the remaining cross hatched micro valleys.

SUMMARY OF THE INVENTION

It is therefore an object of this invention to provide an internal combustion engine valve that is devoid of the above-noted disadvantages.

Another object of this invention is to provide an engine valve with improved wearability in today's advanced engines.

Yet another object of this invention is to provide a valve stem with a surface preparation particularly suitable for the proper retention of a lubricant.

Still another object of this invention is to provide a novel method for the production of valves having improved wear characteristics and improved oil retention properties.

Another still further object of this invention is to provide a novel method and resulting valve that is comparatively economical to manufacture.

Another yet further object of this invention is to provide a novel method of treating the stem surface of a valve whether it has a hard surface or not.

A still another object of this invention is to provide an engine valve that will substantially reduce valve guide and valve seal wear.

These and other objects of this invention are accomplished by surface treatment or retexturing of the metal surface of a valve stem. It has been unexpectedly determined that the topography found on the stem surface should not be completely eliminated but rather should be reduced so as to have an Rp value of from about 4.0 to about 15.0. Rp value is generally defined as a measurement of surface peak height. The precise technical definition of Rp values and other significant measurements or values are found in *Surface Texture Analysis-The Handbook* by Leigh Mummery, published in West Germany by Hommalwerke GmbH, *Alte Tuttlinger Str.* 20, 7730 YS-Muhlhausen, West Germany published in 1990 and printed in West Germany by Schnerr. This handbook is incorporated into this disclosure by reference.

In addition to providing the stem surface topography having peak heights up to about Rp 15, it is critical to this invention that the valve stem surface be provided with a microscopic cross hatching to support an oil film in an amount just sufficient for proper lubrication. This combined surface peak height of up to about Rp 15 and microscopic cross hatched channels provide a novel valve stem having characteristics resulting in reduced emission problems, better lubrication properties, substantially improved or reduced valve wear and reduced wear to the adjacent valve components.

It is known to super finish metal surfaces, that is a post finishing technique used after the basic manufacture of the metal item. Super finish implies the degree of surface finish necessary to remove the presence of machining marks, flaws and other surface imperfections or irregularities which can be cosmetic or have a metallurgical tendency to promote a failure due to surface texture. It is also known to re-texture a metal surface by cross hatching its surface to the degree desired. Apparatuses capable of cross hatching and super finishing a metal surface are GEM models 04150-P and 08150-F available from the Grinding Equipment and Machinery Co. Inc., Box 2747, Youngstown, Ohio 44507. Another apparatus which is suitable to provide the cross hatching as used in the present ivention is the Supfina models SE 30 and SE 40 available from Supfina, Maschinenfabrik Hentzen GmbH & Co. KG, P.O.B. 100854, Greulingstrasse 33, D-5630 Remscheid, Fed. Rep. of Germany. The degree of cross hatching and depth of these channels or ridges are determined in the present invention by the unique requirements of each valve to be manufactured. By providing the novel surface treated valves of this invention, combined testing of valve guides and seals indicated that both component longevities were significantly improved. This was because of combined surface characteristics of the present valve stem, i.e. Rp value of up to about 15 and cross hatched channels throughout substantially the length of the valve stem. It is important to this invention that the micro cross hatching be precision controlled so as to support and retain only that amount or film of oil necessary for proper mating lubrication purposes but not an amount that could build up and enter the combustion chamber. By "micro hatching", "microscopic cross hatching", "micro-grooves" and "micro-channels" is meant a hatch groove having a depth not exceeding an Rvk value of 30 micro-inches. It is preferred to have a depth of from about Rvk 2–30micro-inches for best results. If the depth exceeds an Rvk value of 30 micro-inches, an excess of oil or lubricant will be held in the grooves exceeding that amount needed for proper lubrication. Also, the excess of oil held in the grooves will drain down into the engine combustion chamber and cause severe emission problems. The Rvk value is a precise measurement of the depth of these micro-grooves or channels and is a measurement well known in the art; see *Surface Texture Analysis-The Handbook* cited above. The Rvk and Rp measurements which are standard in the art are both defined in this publication. The degree of cross hatching required is directly dependent on the desired emission standard, the design of the valve seal (material, tension and surface contact), the type of lubricant used, the allowed engineering tolerance of both the guide and the seal in hot and cold conditions and the practical finish characteristic of the machine guide. Thus, the parameters of the cross hatched channels are determined only by these unique considerations.

While super finishing and micro cross hatching of metal surfaces are known, they have never been combined for use on engine valves having the criteria above described. The unique valve of this invention balances several critical requirements, low emission, adequate lubrication and improved wearability. This configuration minimizes the flow of excess oil down the valve stem into the combustion chamber while at the same time providing substantially improved lubricating properties.

The valves used today are generally made from a ferrous material and usually are chrome plated. They can, however, for purposes of this invention be used uncoated or coated with any suitable coating material such as nitriding, nickel or any other suitable coating material. The valve seal is generally made from an elastomer since sealing properties are desirable to prevent oil from leaking into the combustion chamber of the engine. The valve guide is generally constructed of a ferrous material but may be made from any suitable composition.

The valve of this invention is prepared as follows: convention steel or ferrous valves are obtained from a North American manufacturer such as TRW or Eaton Corporation. These valves as received will have a roughness on the surface of the stem. The valve is coated by conventional methods with a material such as chrome, nickel or nitriding. The normal result of the coating of the valve stem is a plurality of surface roughness having an Rp value of about 80 $\mu$ in. That is, the maximum peak height of these nodules is about 80 $\mu$ in. or above. The resulting coated valve is then placed in an apparatus similar to those discussed in U.S. Pat. No. 5,042,204 to polish or super finish the valve surface and to reduce the Rp value of the surface peaks to 15 or below but not to zero. The valve is then placed on a GEM microfinisher as noted above to provide the cross hatching channels along substantially the length of the valve stem. As noted earlier, the depth of the cross hatching channels can be regulated on the Gem Oscillation apparatus depending upon the desired specifications. By cross hatching is meant throughout this disclosure as the type of cross hatching imparted on a metal surface by the GEM 04150-P and GEM 08150-F finishers. The criteria being to provide channels having depth or micro depths to adequately hold oil to properly lubricate but not so much as to cause oil flow down into the combustion chamber. This process can also be used on uncoated valves acting only on the uncoated steel stem surface. Also, the sequence of the super finishing step and the cross hatching step can be reversed or even done concurrently if suitable. The important aspects are the reduction of the surface peak heights Rp to a value preferrably of from about 4.0 to 15 and the cross hatching of the surface. When the valve is placed in or on the Gem machine, the valve is rotated as the abrasive belt on the Gem moves laterally and longitudinally (oscillation) while in contact with the valve stem. The material on the abrasive belt can be selectively installed depending upon the cross hatching desired. Usually a 3 to 45 micron abrasive particle belt is used but any suitable size particle can be used. The cross hatching grooves have a bonus advantage since in use they come into the seal surface at a tangent and not perpendicular. When the grooves are horizontal or longitudinal or perpendicular to the surface of the seal, the edges of the grooves abrade the seal surface and cause substantial wear. The cross hatching permits the valve surface to enter and move within the valve seal where the edges of the grooves are not at a severe wearing position as are the horizontal or vertical (perpendicular to the plane of the seal surface) groove edges.

The conventional valve comprises on one terminal portion a "head", on the opposite terminal portion a "tip" and therebetween is a "stem". The stem is the portion of the valve treated by this invention.

The following examples illustrate test comparisons between prior art valves and valves made according to this invention:

EXAMPLE 1

| Stem Kind | Prior Art Standard 1 | Present Invention | Prior Art Standard 2 |
|---|---|---|---|
| Stem Dia. (mm) | 8.650 | 8.645 | 8.665 |
| Roughness Before Test umRmax(Ra) ($R_{Peak}$) | 1.35 (0.149) (0.42) | 0.76 (0.058) (0.17) | 1.54 (0.114) (0.40) |
| Roughness After Tested umRmax(Ra) ($R_{Peak}$) | 1.40 (0.130) (0.40) | 0.76 (0.057) (0.13) | 1.50 (0.100) (0.33) |
| Interference Before Test (mm) | 0.91 | 0.91 | 0.88 |
| Interference After Tested (mm) | 0.89 | 0.91 | 0.87 |
| Contact Load Before Test (kg) | 1.68 | 1.65 | 1.68 |
| Contact Load After Tested (kg) | 1.68 | 1.65 | 1.64 |
| Lip Wear Area ($\times 10^3$ mm$^2$) | 0 | 0 | 0 |
| Lip Surface Condition | Good | Excellent | Good |

Definition of Lip Surface Condition:

Excellent—Burnish (polish) curing lip surface remain. No scratch, porous and any other abnormalities. Can't tell the difference from new seal.

Good—Very slightly porous, the trace of lip contact area unclear.

Acceptable—Very slightly porous but the trace of lip contact area can be clearly judged.

Poor—Lip wear observed, porousness surface.

Worse—Lip contact area are entirely wear, vertical scratch, dry and rough wear surface Three valves were tested, a standard prior art valve 1, a standard prior art valve 2 and the valve of the present invention. The lip surface condition of the seals in contact with each of these valves was examined, rated and recorded. The test time was 20 minutes at room temperature, with a pre-lube of 0.02 cc of oil added to each. The present valve was rated "excellent", substantially better than the other two.

EXAMPLE 2

| Stem Kind | Prior Art Standard 1 | Present Invention | Prior Art Standard 2 |
|---|---|---|---|
| Stem Dia. (mm) | 8.648 | 8.650 | 8.670 |
| Roughness Before Test umRmax(Ra) ($R_{Peak}$) | 1.5 (0.10) (0.90) | 1.4 (0.08) (0.18) | 1.17 (0.088) (0.27) |
| Roughness After Tested umRmax(Ra) ($R_{Peak}$) | 1.3 (0.11) (0.40) | 0.85 (0.057) (0.14) | 0.96 (0.080) (0.25) |
| Interference Before Test (mm) | 0.90 | 0.91 | 0.92 |
| Interference After Tested (mm) | 0.89 | 0.91 | 0.90 |
| Contact Load Before Test (kg) | 1.67 | 1.65 | 1.64 |
| Contact Load After Tested (kg) | 1.65 | 1.63 | 1.61 |
| Lip Wear Area ($\times 10^3$ mm$^2$) | 2 | 0 | 1 |
| Lip Surface Condition | Poor | Acceptable | Poor |

Three valves were tested, a standard prior art valve 1, a standard prior art valve 2, and the valve of the present invention. The lip surface of the valve seals in contact with each of these valves was examined, rated and recorded as shown above. The test time was 20 minutes at a low temperature below room temperature. The conditions were dry. The conclusion was that only the valve of the present invention was commercially acceptable.

DETAILED DESCRIPTION OF THE DRAWINGS AND THE PREFERRED EMBODIMENTS

Figure 1:
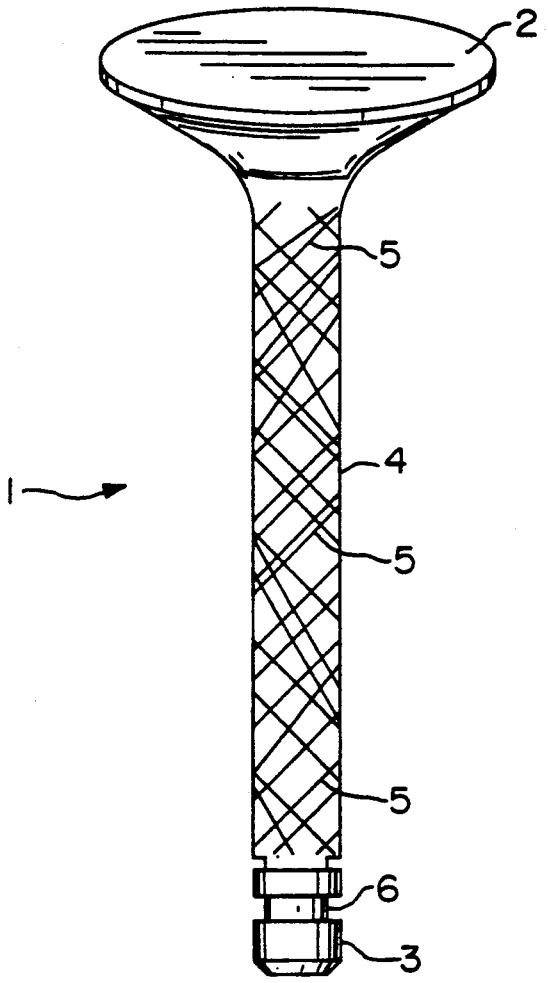
FIG. 1 is a plan view of the valve of this invention showing the microscopic cross hatching which is not visible to the human eye.
Figure 2:
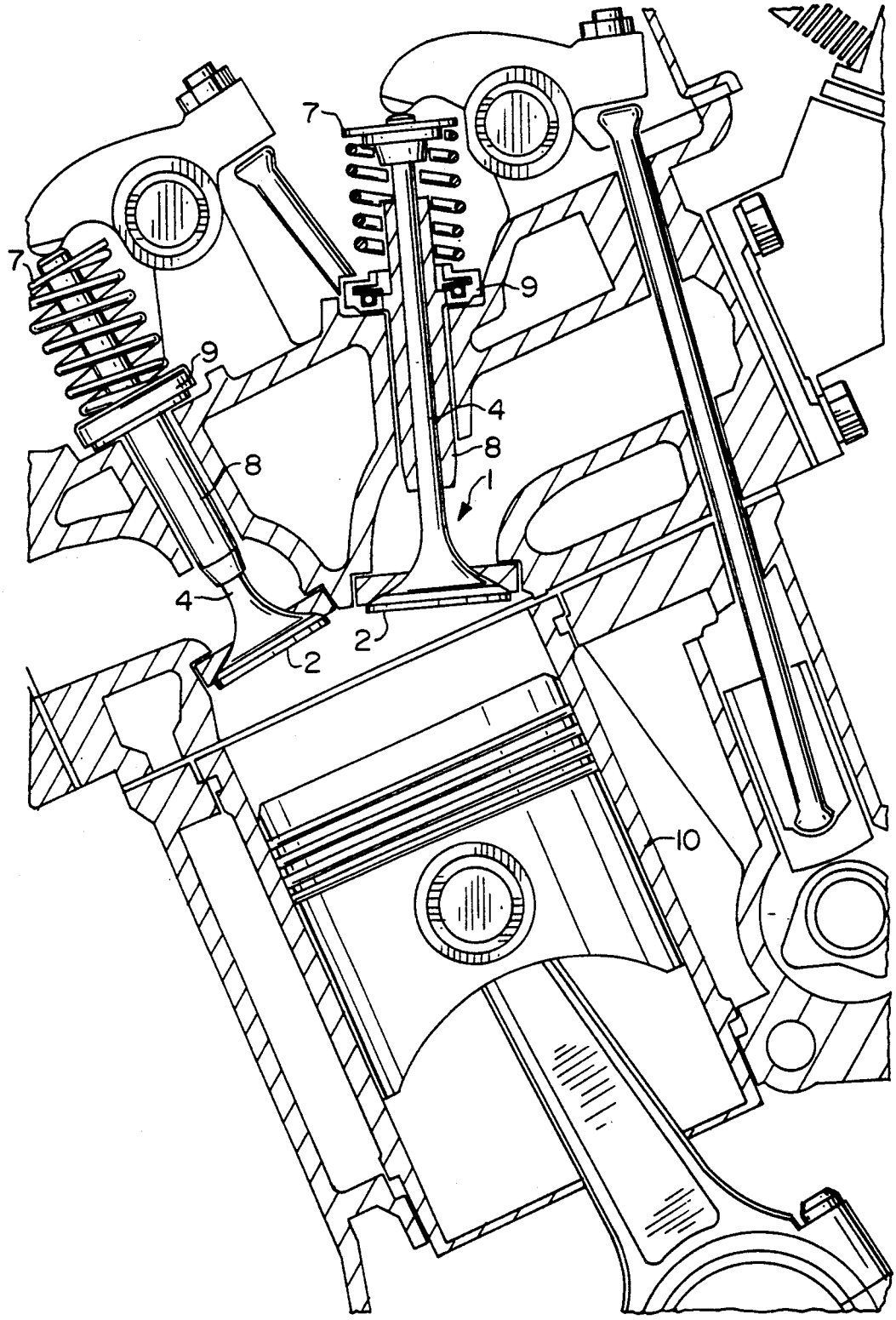
FIG. 2 is a plan view of a cutaway portion of an internal combustion engine showing the relationship of the valve with engine adjacent or component parts.
Figure 7:
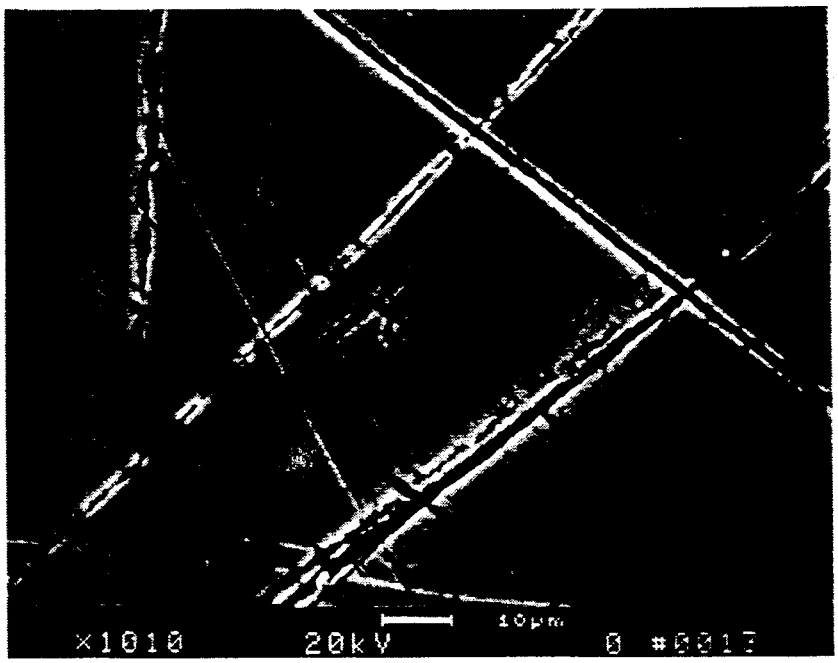
FIG. 7 is a top view microphotograph of the surface of the valve of the present invention showing the cross hatching but having nodules indiscernible to a microphotograph, the surface peak height has a Rp value of about 4.0 to about 15.0.
Figure 8:
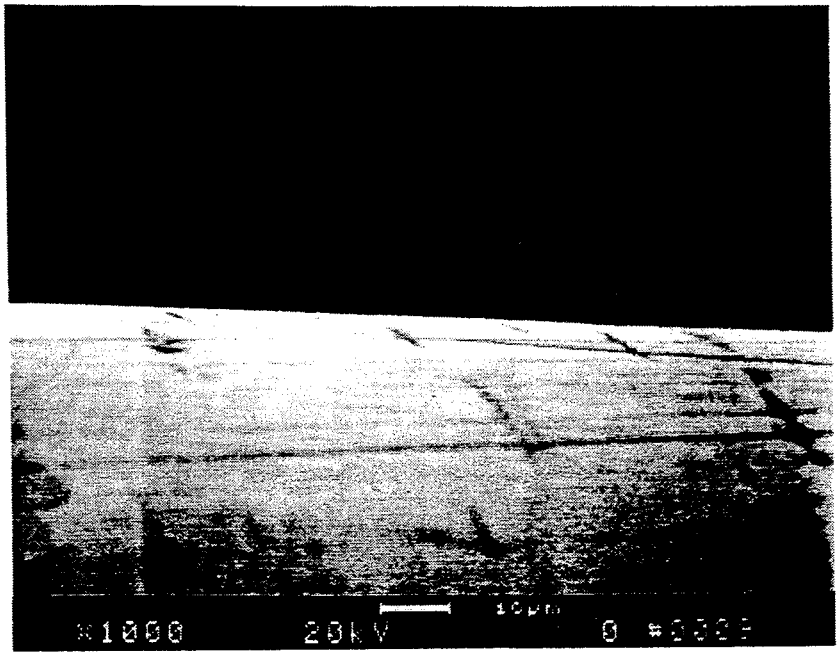
FIG. 8 is a horizontal view microphotograph of the valve surface of FIG. 7.

In FIG. 1 the valve 1 of this invention is shown having a head portion 2, a tip portion 3 and a stem portion 4 positioned therebetween. The stem portion 3 is modified by the method of the present invention. After a coating of chrome, nickel, nitride or other suitable coating is plated on the ferrous stem 4, the nodules on the stem surface are reduced to a surface peak height of from about Rp 4.0 to about 15.0. The surface peaks between Rp 4.0–15.0 are so small so as to not be discernible to even a microphotograph as can be seen in FIGS. 7 and 8. The cross hatching 5 is not visible to the human eye but is shown in FIG. 1 for clarity of defining this invention. The cross hatching 5 extends over the surface of the stem 4 so as to cover the minimum wear surface area that the valve guide and valve seal will travel. The stem 4 thus will preferrably have a surface peak height of about Rp 4.0 to about 15.0. If the surface peak height falls below about Rp 4.0, the surface will become too smooth and oil will flow down the stem and into the combustion chamber of an internal combustion engine as can be seen in FIG. 2. If the surface peak height exceeds about Rp 15.0, the surface will abrade the valve guide and severe wear problems will result. At the top 3 of the valve of this invention hardened cotter grooves 6 are found. These grooves 6 are used to attach the valve 1 to a spring-loaded cap or rotator 7 as seen in FIG. 2. In FIG. 2 the relationship of valve 1 to the other engine components is shown in a push rod engine, but the valve of this invention can be used in any internal combustion engine. The valve 4 to the right as viewed in the drawing is shown with the valve guide 8 broken away whereas the valve 4 to the left in FIG. 2 shows the valve guide 8 completely around the valve 4 as in actual usage. Encircling a major portion of stem 4 is a valve guide 8 which fits snugly around stem 4. It is this interior section of valve guide 8 that becomes abraded by the prior art stem surfaces having relatively high Rp's and uneven surface imperfections. Surface "imperfections" include machine or process scratches, nodules, and other surface irregularities which result in a less than smooth surface. To avoid this, the present valve stem surface 4 has a surface peak height not exceeding Rp 15.0. But yet the surface of the stem of the present invention is not perfectly smooth since that would cause problems previously mentioned; i.e. oil flow down, emission problems, uneven wear, etc. To insure that there is sufficient lubrication between stem 4 and the interior surface of valve guide 8, a cross hatch pattern is scratched into the surface to the extent needed for the particular valve 1. This cross hatching is defined as the type imparted by GEM machines GEM 04150-P and GEM 08150-F micropolishers. A seal 9 is located at the top portion of valve guide 8 and in direct contact with stem 4. It is also because of abrasion and wear on this elastomeric seal 9 that the nodules or surface peak height on stem surface 3 is reduced to from Rp 4.0 to 15.0. Without the proper stem texture of this invention oil would drip down into combustion chamber 10 and severe emission problems could result. The cross hatched texture of this invention supports a microscopic film of oil for proper lubrication but excess oil is not allowed to build up. The surface peak height of from about Rp 4.0 to 15.0 provides substantial reduced wear on the valve guide 8 and valve seal 9. Therefore, the valve stem of this invention provides a texture that is smooth enough to cause minimal wear on contacting parts while at the same time being rough enough to retain a sufficient amount of oil to properly lubricate contacting parts.

Figure 3:
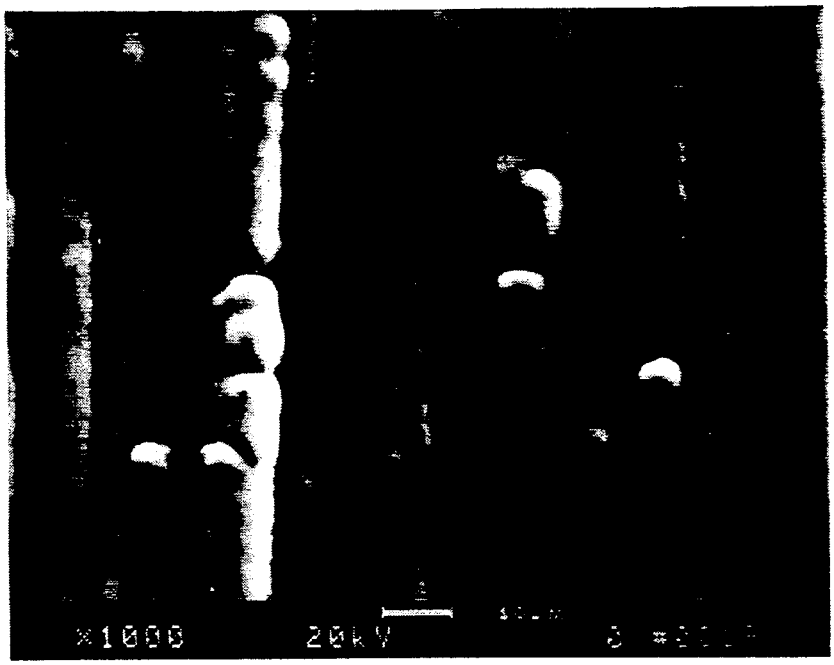
FIG. 3 PRIOR ART
FIG. 3 is a top view microphotograph of a surface of a plated prior art valve showing the large nodules thereon.
Figure 4:
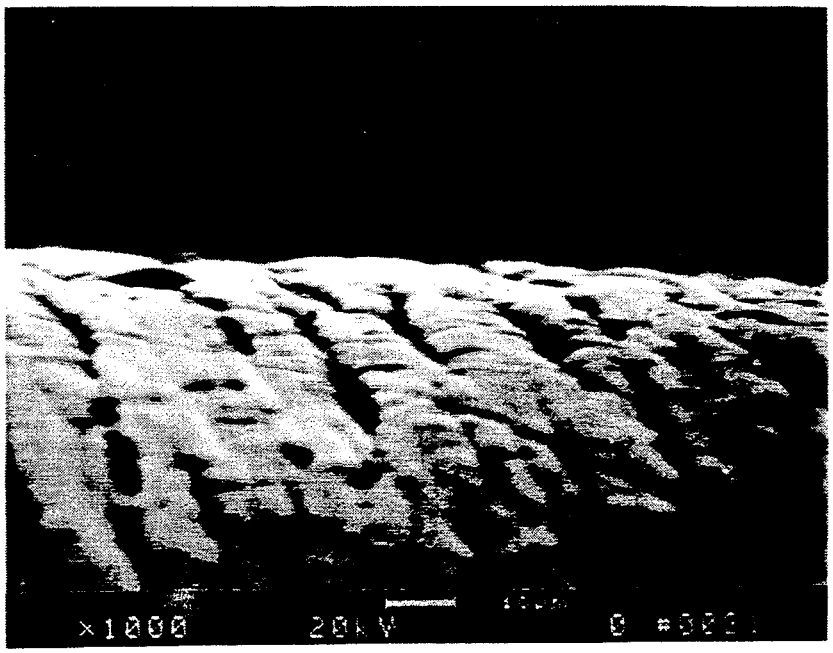
FIG. 4 PRIOR ART
FIG. 4 is a horizontal view microphotograph of a surface of the plated prior art valve of FIG. 3.

In FIGS. 3 and 4 microphotographs show prior art valve stem surfaces having substantial nodules where the surface peak height exceeds an Rp of 15.0, i.e. about Rp 100. FIGS. 3 and 4 show a chrome-plated stem without the polishing step. FIG. 3 is a top view or a view taken perpendicular to the surface and FIG. 4 is a horizontal view taken along a tangent line from the surface. Each shows the rough surface that abrades and causes wear to the seal guide 8 and seal ring 9 as shown in FIG. 2.

Figure 5:
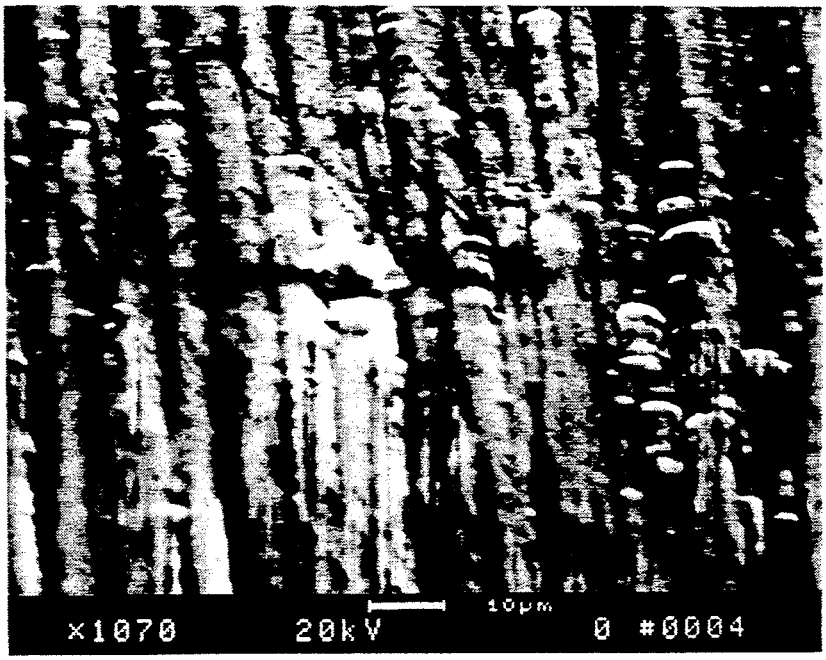
FIG. 5 PRIOR ART
FIG. 5 is a top view microphotograph of a surface of a plated and polished prior art valve showing the reduced nodules thereon.
Figure 6:
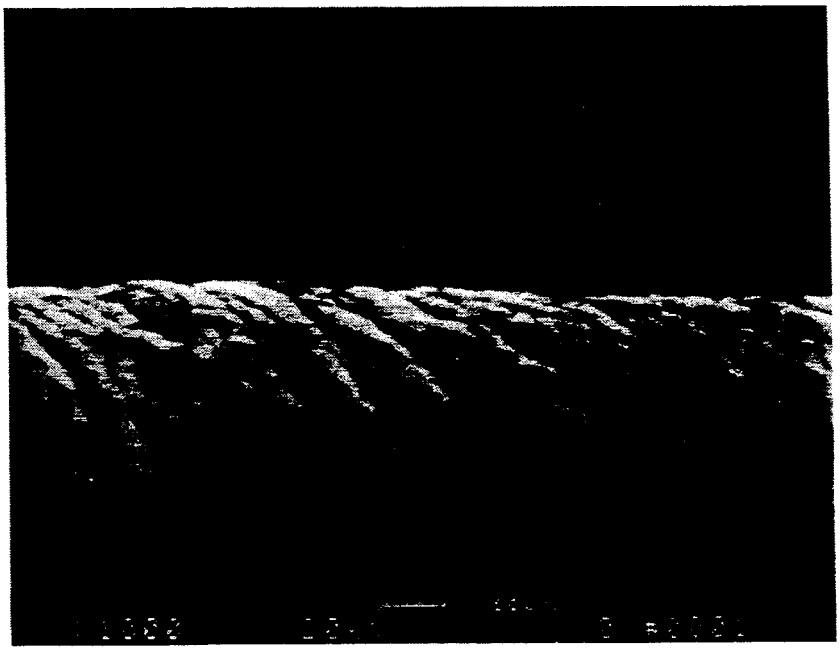
FIG. 6 PRIOR ART
FIG. 6 is a horizontal view microphotograph of the surface of the valve surface of FIG. 5.

FIGS. 5 and 6 are microphotographs showing prior art valve stems after plating and polishing. Again, FIG. 5 shows dramatically the rough surface from a top view and FIG. 6 shows this same surface from a horizontal view or a view taken along a tangental plane to the surface.

FIGS. 7 and 8 show a microphotograph of the surface of the valve stem of the present invention. The cross hatching is clearly seen in both figures and some slight surface texture can be seen in FIG. 8. This FIG. 8 surface has a surface peak height measured at about Rp 4.0 to 15.0. Thus, the combined surface characteristic of this invention is Rp 4.0 to 15.0 and cross hatching revealed substantial reduced wear on both the guide 8 and seal 9.

The preferred and optimumly preferred embodiments of the present invention have been described herein and shown in the accompanying drawings to illustrate the underlying principles of the invention but it is to be understood that numerous modifications and ramifications may be made without departing from the spirit and scope of this invention.

What is claimed is:

1. A metallic valve for use in internal combustion engines comprising on one terminal end a tip portion, on an opposite terminal end a head portion and between said tip and said head portions is located a stem portion, said stem portion connecting said head portion and said tip portion, providing thereby the entire metallic valve structure, said stem portion having on its exterior portion a surface roughness having an Rp value of from about 4.0 to about 15.0, said exterior portion of said stem also having throughout substantially its entire length a cross hatching channel pattern, said cross hatching channel pattern having a depth of an Rvk value of up to about 30 micro-inches which is sufficient to hold a lubricant to provide proper lubrication for said valve and adjacent surfaces while at the same time minimizing any emission problems.

2. The metallic valve of claim 1 wherein at least the stem portion is uncoated.

3. The metallic valve of claim 1 wherein at least the stem portion is coated with chrome.

4. The metallic valve of claim 1 wherein at least the stem portion is coated with a nitride composition.

5. The metallic valve of claim 1 wherein at least the stem portion is coated with a nickel composition.

6. A metallic valve for use in internal combustion engines which comprises on one end portion a tip section, on an opposite end portion a head section and between said tip section and said head section is a stem portion, said stem section having on its exterior portion a surface roughness having an Rp value of from about 4.0 to about 15.0, said exterior portion of said stem having throughout substantially a major portion of its length a cross hatching pattern, said cross hatching pattern having a depth of an Rvk value of from about 2.0 to about 30 micro-inches which is sufficient to provide valve lubrication to minimize adjacent surface wear while at the same time minimizing lubrication drain down into an engine combustion chamber.

7. The metallic valve of claim 6 wherein the stem is uncoated.

8. The metallic valve of claim 6 wherein the stem is coated with a material selected from the group consisting of a nitride composition, chrome, nickel or mixtures thereof.

9. A method for making a metallic valve for use in internal combustion engines which comprises providing a valve having a valve tip portion on one terminal end, in an opposite terminal end a head portion, and a stem portion between said tip portion and said head portion, said stem portion having surface imperfections on its outer surface, adjusting the height of said imperfections so as to have an Rp value of from about 4.0 to about 15.0, providing on the outer surface of said stem portion a plurality of cross hatched channels, said cross hatched channels being formed on a substantial portion of the length of said stem portion, adjusting the depth of said cross hatched channels to have an Rvk value of up to about 30 micro-inches which is capable of maintaining a thin film of oil for proper lubrication and sufficient to prevent oil drain down from said valve.

10. The method of claim 9 wherein said valve is coated prior to adjusting the height of said imperfections and prior to providing said cross hatched channels therein.

11. The method of claim 9 wherein said valve is coated subsequent to adjusting the height of said imperfections and subsequent to providing said cross hatched channels therein.

12. The method of claim 9 wherein said valve is coated with a material selected from the group consisting of chrome, nickel, a nitride composition and mixtures thereof, said material coated thereon prior to adjusting the height of said imperfections and prior to providing said cross hatched channels therein.

13. The method of claim 9 wherein said cross hatched channels or grooves are micro-channels not readily visible to the naked eye, said micro channels having a depth of an Rvk value of from about 2.0 to about 30 micro-inches.

14. The method of claim 9 wherein said valve is constructed of a ferrous material coated with chrome.

15. The method of claim 9 wherein the valve is sequentially treated to reduce the height of said imperfections to a Rp value of from about 4.0 to about 15.0 and then cross hatched throughout substantially its entire length.

16. The method of claim 9 wherein the valve is sequentially cross hatched throughout substantially its entire length and then treated to reduce the height of said imperfections to an Rp value of from about 4.0 to about 15.0.

17. The method of claim 9 wherein the valve is substantially in one operation concurrently cross hatched throughout substantially its entire length and treated to reduce the height of said imperfections to an Rp value of from about 4.0 to about 15.0.

* * * * *